US005232647A

United States Patent [19]

Sampanis et al.

[11] Patent Number: 5,232,647

[45] Date of Patent: Aug. 3, 1993

[54] PROCESS OF MAKING BICOMPONENT ACRYLIC FIBERS HAVING REVERSIBLE CRIMP

[75] Inventors: Spero Sampanis, Pensacola; Ronald E. Pfeiffer, Oriole Beach; Francesco De Maria, Gulf Breeze; William E. Streetman, Pensacola, all of Fla.; Maurice M. Zwick, Stamford, Conn.

[73] Assignee: American Cyanamid Company, Stamford, Conn.

[21] Appl. No.: 860,488

[22] Filed: Mar. 30, 1992

Related U.S. Application Data

[62] Division of Ser. No. 625,409, Dec. 11, 1990, Pat. No. 5,130,195.

[51] Int. Cl.[5] ..... D01D 5/22; D01F 6/18; D01F 8/08

[52] U.S. Cl. ..... 264/168; 264/171; 264/182; 264/210.7; 264/210.8; 264/211.15; 264/211.17; 264/233

[58] Field of Search ..... 264/168, 171, 182, 210.7, 264/210.8, 211.14, 211.15, 211.17, 233, 282, 290.5

[56] References Cited

U.S. PATENT DOCUMENTS 3,984,515 10/1976 Mommaerts et al. ..... 264/182
4,332,762 6/1982 Lynch ..... 264/168

FOREIGN PATENT DOCUMENTS 330766 9/1989 European Pat. Off. .

*Primary Examiner*—Leo B. Tentoni
*Attorney, Agent, or Firm*—Frank M. Van Riet

[57] ABSTRACT

An acrylic fiber tow which includes 1) monocomponent filaments of each of two acrylonitrile polymers differing in hydrophilic properties, 2) bicomponent filaments of both of said polymers having one interface between polymers components and 3) bicomponent filaments of both of said polymers having more than one interface between polymer components. This fiber, however, in spite of its composition of numerous filaments of differing structure provides a tow bundle having a desirable level of reversible crimp measured in a manner specific to the type of crimp designated.

5 Claims, 1 Drawing Sheet

PROCESS OF MAKING BICOMPONENT ACRYLIC FIBERS HAVING REVERSIBLE CRIMP

This is a divisional of co-pending application, Ser. No. 07/625,409, filed Dec. 11, 1990 now U.S. Pat. No. 5,130,195.

BACKGROUND OF THE INVENTION

Bicomponent fibers are composed of two polymer compositions which are concentrated in separate areas of the filaments. In some prior art types, each polymer composition is continuous along the entire fiber length and the two components are permanently joined at an interface so as to form a side-by-side arrangement. Polymer compositions forming the components are selected on the basis of their ability to shrink or swell to different extents in response to hot-wet conditions. As a result, when fibers formed from the selected combination of polymer components are properly treated, differential shrinkage of the components will occur and a spiral or helical crimp will form. The extent of crimp development will depend upon the shrinkage differential between polymer components employed, distribution of components in the fiber and the presence of translational restraints which may inhibit crimp development.

Two different types of bicomponent acrylic fiber are usually produced. One contains different amounts of water-ionizable groups in the two polymer components and, as a consequence, the more hydrophilic side of the resulting fiber swells more in water. Crimp develops when the fiber is dried after hot-wet treatment. The spiral crimp thus developed is water-reversible, it decreases upon wetting while exhibiting squirming and reforms upon drying In the second bicomponent type, the two polymer components contain different amounts of nonionic comonomers. Crimp develops in such fiber when the oriented fiber is treated under conditions where adequate differential shrinkage develops between the two polymer components. Once formed, this helical crimp is permanent and unaffected by subsequent wetting and drying.

In preparing bicomponent fibers as described above, special equipment is necessary to channel the two separate polymer solutions into each orifice of the spinnerette so as to provide the homogeneous side-by-side arrangement of components in the fiber. Differences in the equipment useful will arise depending upon the method of spinning employed.

To produce acrylic fiber having a homogeneous side-by-side bicomponent structure and a hot water reversible spiral crimp, it has previously been necessary to employ dry-spinning procedures using suitable special equipment and organic solvents for the polymer to provide spinning compositions and subsequently consolidating the fiber by evaporation of the solvent. This procedure is effective with only a very limited number of orifices in the spinnerettes and thus is of limited productivity. Additionally, the requirement for complete solvent recovery to prevent environmental pollution further complicates production. Therefore, at the present time there continues to exist the need for a fiber possessing the desired reversible crimp and for a simplified process for preparing such a fiber. The fiber type is particularly desirable for use in craft yarn, apparel, and other end products.

In general, to produce fibers having built-in crimp, either wet or dry spinning procedures may be employed and the fibers may be eccentrically- bicomponent without the specific requirement for a side-by-side arrangement, for example, a sheath-core arrangement (although bicomponent fibers of the side-by-side arrangement are preferred for some end uses). The polymer solvent may be an organic compound or an aqueous solution of certain inorganic salts or acid.

Although a diversity of procedures may be employed to spin acrylic fibers which have irreversible helical crimp, only the organic solvent spinning procedures using relatively small spinnerettes have hereto been effective in spinning acrylic fiber having reversible spiral crimp accepted in the market place.

Since the wet-spinning procedure enables spinnerettes of very large numbers of orifices to be employed, it would be highly desirable to provide a wet-spinning procedure for producing acrylic fiber having reversible built-in crimp wherein the necessity for separately channeling the two polymer components to each orifice of the spinnerette is eliminated. Such a provision would greatly reduce the requirements for special equipment and can substantially increase productivity.

With the development of static mixing units and advances in static mixing technology [see e.g., Chem. Eng. Progress 82/7, 42–48(1986)], the utilization of such devices in fiber spinning has been studied. Many new species of multilayered bicomponent arcylic fiber types have been reported using adaptations of static mixing units in conjunction with wet-spinning procedures [see e.g., U.S. Pat. No. 4,297,412 Achard (1981); U.S. Pat. No. 4,307,054 Chion (1981); Toray European Application 330,766 Osino (1988); and Toray Japanese Applications JO-1229-812, JO-1229-813, JO-1229-814, JO-1239-127, and JO-1239-161 (all 1988)]. However, up to the present time, procedures employing static mixing units in conjunction with wet-spinning to provide acrylic fiber with a high degree of reversible crimp have not been developed.

SUMMARY OF THE INVENTION

This invention relates to a tow bundle of filaments of acrylic fiber which exhibits reversible squirming crimp when exposed to hot-wet conditions in spite of the fact that the two different acrylonitrile polymers making up the composition of the fiber show a heterogeneous arrangement in round cross-sections of individual filaments rather than the homogeneous side-by-side arrangement seen in prior art filaments that exhibit this particular type of crimp. This invention also relates to a process for wet-spinning the novel fiber in which a static mixing unit is used in conjunction with a spinnerette normally used for wet-spinning monocomponent filaments.

In accordance with the present invention, there is provided an acrylic fiber bundle consisting essentially of a tow of a large number of individual filaments, said filaments comprising 1) monocomponent filaments of a first acrylonitrile polymer containing at least about 85 weight percent acrylonitrile and a sufficient number of sulfonic acid groups to be hydrophilic, 2) monocomponent filaments of a second acrylonitrile polymer containing at least about 85 weight percent acrylonitrile and a lesser proportion of sulfonic acid groups than said first polymer, 3) bicomponent filaments of both of said polymers having a single interface between polymer components and 4) bicomponent filaments of both of said polymers having more than one interface between polymer components, said sulfonic acid groups being present in a ratio in the range of about 2.5:1 to 9:1 of those of said first polymer to those of said second polymer, respectively, and the combination of filament types present being sufficient to provide a fiber bundle having a reversible crimp of at least about 12 percent.

A highly surprising feature of the fiber of the present invention is that it provides a desirably high percentage of reversible crimp in spite of the fact that it does not contain an exclusive content of bicomponent filaments having a single interface between polymer components.

In accordance with the present invention, there is also provided a process for wet-spinning an acrylonitrile polymer fiber tow having a reversible crimp of at least about 12 percent which process comprises preparing separate spinning solutions of two acrylonitrile polymers each containing at least about 85 weight percent acrylonitrile and sufficient sulfonic acid groups, the ratio of sulfonic acid groups, of the first polymer to the second being in the range of from about 2.5:1 to about 9:1, simultaneously passing the separate solutions through opposite sides of a static mixing unit equipped with a number of flow-reversing cutting elements into a spinnerette having a rectangular or circular shape and a number of orifices such that the calculated number of polymer interfaces per filament (I) is between about 0.4 and 2.8, as determined by the equation:

$$I = \frac{2^n - 1}{K \times (\text{no. of spinnerette orifices})^{\frac{1}{2}}}$$

wherein the superscript n is the number of said cutting elements in said mixer and K is a constant equal to 1.0 for rectangular spinnerettes and 1.1 for circular spinnerettes, to form a polymer mixture containing from about 30 weight percent to about 70 weight percent, of the first polymer and, correspondingly from about 70 weight percent to about 30 weight percent of the second polymer, spinning said polymer mixture into a coagulating bath to provide wet-gel filaments, stretching the wet-gel filaments at a total stretch ratio between about 6 and 15, inclusive, drying the filaments to provide a tow, relaxing the tow under heat and humidity conditions such as to provide a total tow shrinkage of between about 20 and 45 percent, based on the stretched length of the filaments before drying, and recovering the resultant tow. Preferably, the solvent and the coagulating bath are aqueous thiocyanate salt solutions.

In order to provide the fiber of the present invention, a wet spinning process in accordance with well-known procedures for preparing acrylic fiber is used. The spinning compositions may vary in polymer concentration from about 7.5 weight percent to about 15 weight percent depending upon the molecular weight of the polymer chosen, the higher the molecular weight the lower weight percent.

Useful acrylonitrile polymers contain at least about 85 weight percent of acrylonitrile but may contain as much acrylonitrile as possible as long as the provision for sulfonic acid groups is made. There is a difference in the content of sulfonic acid groups in the two polymers chosen and there must be at least some sulfonic acid groups in both polymers. Generally, the lowest amount of sulfonic acid groups, calculated as the sodium salts, desirable is about 0.40 weight percent for the polymer of low sulfonic acid group content. This amount may occur in the polymer without the need for a comonomer containing sulfonic acid groups when the polymerization reaction is controlled by a redox catalyst system such as sodium persulfate/sodium bisulfite, or it may be provided by an appropriate amount of suitable comonomer. The difference in the content of sulfonic acid groups, will be such that the ratio of such group content will be in the range of from about 2.5:1 to about 9:1, based on that of the higher to the lower sulfonic acid polymer content, respectively. If the ratio is below this range, it is not possible to achieve the desired level of reversible crimp in the resulting tow. If the ratio is above this range, other fiber properties are adversely affected.

It is generally preferred that the polymer solutions be of similar viscosity so as to provide sharply defined interfaces therebetween. If the polymers are of the same range of molecular weight, solutions of the same polymer concentration will have similar viscosities. However, if the polymers differ substantially in molecular weight, the concentrations of polymers in solution may be varied to obtain similar viscosities.

Reversible crimp percentages in the specified range may be obtained when the polymers are used in equal amounts so as to provide a 50:50 ratio of the two polymers in the resulting fiber tow. Good results are also obtained when the usage of polymers in the fiber tow ranges from about 30:70 to about 70:30 of one to the other. Such ranges may be obtained from different polymer concentrations in the separate solutions or by metering the flow of the separate solutions through the static mixing unit accordingly.

Acrylonitrile polymer fibers having reversible crimp and which squirm when wet but have an exclusive side-by-side distribution of polymer components by virtue of having been spun through special spinnerettes which keep the two polymer solutions separate until they exit from the spinnerette orifices are described, for example, in U.S. Pat. No. 2,837,500, Anderson (1958); U.S. Pat. No. 2,988,420, Ryan (1961); U.S. Pat. No. 3,038,236; Breen (1962); U.S. Pat. No. 3,028,240 Kovarik (1962); U.S. Pat. No. 3,039,237, Taylor (1962); U.S. Pat. No. 3,039,524, Belck (1962); U.S. Pat. No. 3,092,892, Ryan (1963); and U.S. Pat. No. 3,864,447, Lekiguchi (1975); U.S. Pat. No. 4,284,598, Craig (1981); and U.S. Pat. No. 4,309,475, Hoffman (1982).

Generally, the acrylonitrile polymer contains at least 85 weight percent acrylonitrile and the indicated amount of sulfonic acid groups. The polymer containing the higher amount of sulfonic acid groups will contain a comonomer which provides most of these groups, while a redox catalyst used to control the polymerization can supply the balance. The polymer containing the lower amount of sulfonic acid groups may derive all of such groups from the redox catalyst or may rely, in part, upon a small content of suitable comonomer. The amounts of sulfonic acid groups introduced into the polymer by the redox catalyst should be taken in account when determining the ratio of sulfonic acid groups of the two polymers. In addition to acrylonitrile and provision for the sulfonic acid groups, the polymers may contain one or more comonomers so long as they do not have a significantly adverse effect on the desired crimp properties. Comonomers containing weak acid groups, such as carboxylic acids may augment the extent of reversible crimp developed when used in the more hydrophilic polymer, i.e. that containing the greatest amount of sulfonic acid.

Suitable comonomers useful in preparing the desired acrylonitrile polymers may be selected from, but are not limited to, for example, methyl acrylate; ethyl acrylate; butyl acrylate; methoxymethylacrylate; beta-chloroethyl acrylate and the corresponding esters of methacrylic and chloracrylic acids; vinyl chloride; vinyl fluoride; vinyl bromide; vinylidene chloride; vinylidene bromide; allyl chloride; 1-chloro-1-bromo-ethylene; methacrylonitrile; methyl vinyl ketone; vinyl formate; vinyl acetate; vinyl propionate; vinyl stearate; vinyl benzoate; N-vinyl phthalimide; N-vinyl succinimide; methylene malonic esters; itaconic esters; diethyl citraconate; diethyl mesaconate; styrene; dibromostyrene; vinyl naphthalene; 2-methyl-1-vinyl imidazole; 4-methyl-1-vinyl imidazole; 5-methyl-1-vinyl imidazole; acrylic acid; methacrylic acid; alpha-chloroacrylic acid; itaconic acid; vinyl sulfonic acid; styrene sulfonic acid; methallyl sulfonic acid; p-methoxyallyl benzene sulfonic acid; acrylamidomethylpropane sulfonic acid; ethylene-alphabeta-dicarboxylic acids and their salts; acrylamide; methacrylamide; isopropylamide; allyl alcohol; 2-vinylpyridine; 4-vinylpyridine, 2-methyl-5-vinylpyridine; vinylpyrrolidone; hydroxyethyl methacrylate; vinylpiperidone; 1,2-hydroxypropyl methancrylate; and the like.

In preparing the acrylonitrile polymers, it is desirable to employ redox catalyst systems such as, for example, sodium persulfate/sodium bisulfite to initiate and control the polymerization.

Such usage, as indicated, results in sulfonic acid end groups on the polymer formed. The proportions of sulfonic acid end groups in the polymers will vary with the molecular weights of the polymers, higher proportions being present in polymers of lower molecular weight.

It is preferred that an effective amount of a lubricant be added during the spinning process in order to prevent the fibers from fusing or adhering to one another during drying. Suitable lubricants are well known in the art and include fatty acid derivatives such as stearamides. They can be added to the fibers anytime before the drying step.

The two polymers in spinning solution form, are simultaneously charged separately into the two sides of a static mixing unit equipped with a number of flow-reversing cutting elements and then into a spinnerette having a rectangular or circular shape and a number of orifices, as described above. The flow of the polymer solutions through the mixing unit may be metered at different rates so as to provide the desired ratio of the individual polymer in the filaments when such ratio is not fully balanced by the concentration of polymers in the solutions.

A suitable device for carrying out the process of the present invention in conjunction with a conventional wet-spinning spinnerette is a STATIC MIXER ® mixing device (registered trademark of Kenics Corp., Danvers, Mass). Operation of the mixer is described, for example, in J. Soc Cosmet. Chem., 24, 639–653 (1973) and patent literature previously cited. In general, the mixer consists of a series of stationary elements fixed relative to the wall of the pipe in which it is enclosed, which diverts the flow field and causes the layering action. The mixing elements are helical and split the pipe cross-section into two semicircular sections. Each element is twisted through 90 degrees and alternate left and right hand twists are fixed in series down the pipe axis. A cut, as that term is employed, refers to the action to which the polymer compositions are subjected to form layers as they progress from one element to the next. Each cut doubles the number of layers of polymer and the number of interfaces between polymers will be one less than the number of polymer layers. Other suitable mixers include, for example, ISG and LPD mixers made by Ross and static mixing units made by Koch.

In operation, the two polymer solutions are simultaneously charged into the static mixing unit separately to one and to the other side of the first element. The compositions are twisted through 90 degrees to form a two-layered composition and then enter the second element which is positioned so as to receive the two-layered composition at a 90 degree angle from the direction of flow out of the first element. Such action results in cutting the two layers into four layers which are twisted in a direction opposite that of the preceding element and emerge into the next element which is positioned so as to receive the layered composition at a 90 degree angle from the direction of flow of the preceding element and again cut the composition to double the number of layers. This action is repeated through the number of elements employed.

In carrying out the process of the present invention, the number of interfaces between the two polymers in the resulting filaments is critical and is dependent upon the number of orifices in the spinneret employed. Spinnerettes with a small number of orifices require a small number of elements in the mixer while spinnerettes with a large number of orifices require larger numbers of mixer elements. If the number of elements is too low, the resulting tow will contain too many mono-component filaments and an insufficient amount of the desired bicomponent filaments to provide the desired crimp. If the number of elements is too high, the resulting tow will contain too many filaments that contain a high number of plural segments of the two polymers that do not provide the desired crimp at the expense of desired bicomponent filaments which do provide the desired crimp.

After the polymer solutions have received the necessary degree of layering in the mixer, they constitute the spinning dope. This dope is then wet-spun through a spinnerette normally employed for wet-spinning mono-component acrylic fiber, the spinnerette having the shape and number of orifices corresponding to the considerations discussed above. The spun filaments enter into an appropriate coagulation medium in accordance with conventional procedures to provide wet-gel filaments. The wet-gel filaments are subjected to stretching, washing, conditioning and steam relaxing in conformity with usual wet-spinning procedures except stretching is restricted to a total stretch ratio of between about 6 and about 15, inclusive, and the conditioning, drying and steam relaxing is sufficient to provide a total tow shrinkage of from about 20 to 45 percent.

BRIEF DESCRIPTION OF THE DRAWING

The invention is more fully illustrated in the examples which follow wherein all parts and percentages are by weight unless otherwise stated.

With reference to the drawings.

Measurement of Tow Hot-Wet/Hot-Dry Shrinkage %

Figure 3:
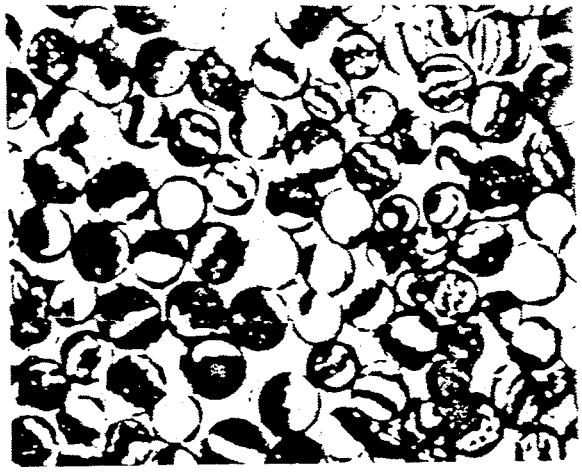
FIG. 3 is a photomicrograph of a cross-section of a filament tow in which the number of interfaces per filament is too high to provide the desired level of desired crimp.
Figure 2:
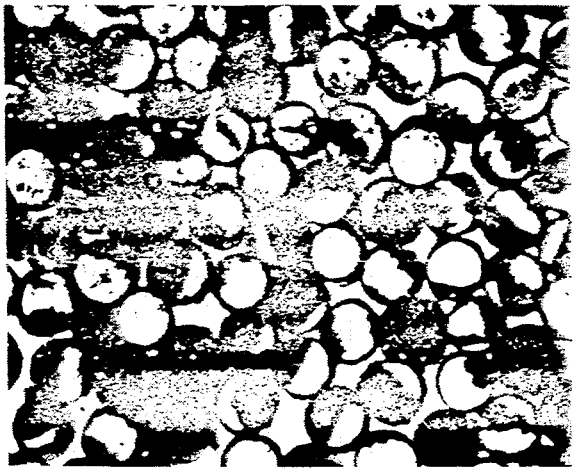
FIG. 2 is a photomicrograph of a cross-section of a filament tow in which the number of interfaces per filament is within the range necessary to provide the desired level of reversible crimp.
Figure 1:
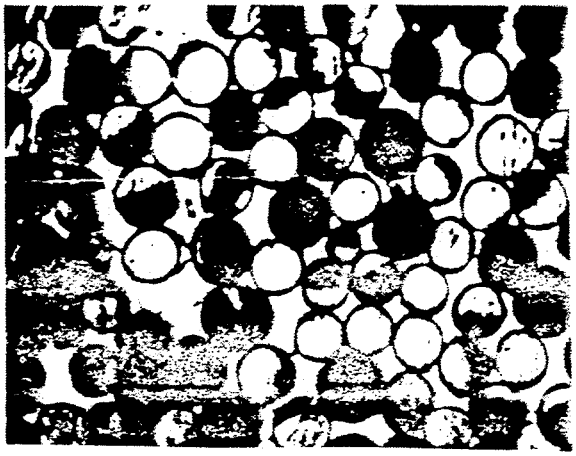
FIG. 1 is a photomicrograph of a cross-section of a filament tow in which the number of interfaces per filament is too low to provide the desired level of reversible crimp.

When a virgin tow of squirming acrylic fiber is being tested for length shrinkage, a heavy weight (0.08 gram/denier, g/d) is hung onto it to straighten it and measure the starting length ($L_o$). This heavy weight pulls out all the crimp that may be present and allows the true length of the fiber bundle to be measured. When the fibers are then boiled off for 30 minutes, kept wet, and again loaded with a heavy weight (0.08 g/d), the new length will be $L_b$. ($L_o$-$L_b$) is then the wet (longitudinal shrinkage) fiber shrinkage.

When the length of the wet fibers is measured with a light weight (0.0019 g/d), the chemical crimp (also called irreversible crimp) is allowed to develop and the length of the fibers measured will be shorter ($L_a$) and ($L_b$-$L_a$) will be the length shortening due to the irreversible chemical crimp.

When the fibers are next tumble dried and their length is measured with a heavy weight (0.08 g/d), the new length $L_2$ is the length with all the crimp removed. Hence ($L_o$-$L_2$) is the total tow length shrinkage (the sum of longitudinal shrinkage during boil-off and subsequent drying).

When the dried fibers are measured with a light weight (0.0019 g/d), the additional shortening to length is due to the total crimp, i.e. the chemical plus the reversible crimp, which is now given by the expression ($L_2$-$L_1$). Since the chemical crimp alone is already known from the wet measurements, the reversible crimp shrinkage alone is equal to ($L_2$-$L_1$) - ($L_b$-$L_a$).

Dividing all the appropriate expressions b $L_o$ will give the results in fractions of the original length and multiplying by 100 will give the percentage values.

To Summarize

Original length of test tow = $L_o$ $$A \text{ - \% wet (longitudinal) shrinkage} = \frac{L_o - L_b}{L_o} \times 100$$

$$B \text{ - \% chemical crimp shrinkage} = \frac{L_b - L_a}{L_o} \times 100$$

$$C \text{ - \% total fiber longitudinal shrinkage} = \frac{L_o - L_2}{L_o} \times 100$$

$$D \text{ - \% dry longitudinal shrinkage} = C - A$$

$$E \text{ - \% total crimp shrinkage (irreversible plus reversible)} = \frac{L_2 - L_1}{L_o} \times 100$$

$$F \text{ - \% reversible (squirming) crimp shrinkage} = E - B$$

$$G \text{ - \% total tow shrinkage (longitudinal wet and dry plus irreversible and reversible crimp)} = \frac{L_o - L_1}{L_o} \times 100$$

The "reversible crimp shrinkage" as that term is used herein and in the appended claims is that value designated by the letter 'F' above, i.e. the reversible (squirming) crimp shrinkage in percent of $L_o$, the before-boil-off length.

EXAMPLE 1

A first acrylonitrile polymer (hydrophobic) of the following composition is employed:

89.4% acrylonitrile
10.6% methyl methacrylate and also containing 0.13% sulfur arising from the redox catalyst. Its kinetic molecular weight ($M_k$) is 49,500. The polymer is dissolved so as to prepare a solution containing 13.5% polymer, 39.5% NaSCN and, 47% water and having a viscosity of 38 poises at 40° C.

A second acrylonitrile polymer (hydrophilic) of the following composition is employed:

89.4 % acrylonitrile
6.7 % methyl methacrylate
3.9 % 2-acrylamido-2-methylpropane sulfonic acid The polymer contains 0.638% sulfur derived both from the sulfonic acid comonomer and the redox catalyst. The kinematic molecular weight is 51,330. A solution of the polymer is prepared, as above, and its viscosity is 40 poises at 40° C.

The content of —$SO_3Na$ groups in the hydrophobic polymer is 0.42% and in the hydrophilic polymer it is 2.05%. The ratio of sulfonic acid groups in the two polymers is 4.9:1 (hydrophilic/hydrophobic), respectively.

The two solutions are simultaneously fed separately to a static mixing unit, one solution to one side of the mixer and the second solution to the other side. The solutions are metered so as to provide a 50:50 ratio of polymer solutions in the layered composite issuing from the mixer. The static mixing unit contains three elements and the circular spinnerette employed contains 120 orifices, each 75 microns in diameter. This produces a calculated number of interfaces per filament of 0.58.

The layered compositions are at a temperature of 70° C. and are pumped through the spinnerette into an aqueous coagulation bath of 14.7% NaSCN maintained at 0° C.

The resulting tow of filaments is removed from the coagulation bath and without further washing is stretched at a stretch ratio of 2.5 in air, washed and hot-stretched at a stretch ratio of 1.9 in a first water-stretching bath at 96° C. and then at a stretch ratio of 1.68 in a second water-stretching bath at 96° C. to provide a total stretch ratio of 8.

Before drying, a fatty acid derivative finish (an emulsified form of stearamide) is applied to the filaments at the level of 150 parts per million. The tow is dried for 30 minutes in a relaxed state at 127° C. dry bulb and 65° C. wet bulb.

The tow is subsequently further relaxed for 10 minutes in a pressure vessel at a steam pressure of 20 pounds per square inch gauge (psig). The total shrinkage is about 35% as a result of drying and steaming.

The tow is restretched in hot water at 88° C. at a stretch ratio of 1.1 and then mechanically crimped at 88° C. after application of a conventional finish (anti-static-softener) and dried at 70° C. for 20 minutes.

Fiber properties are determined in accordance with conventional procedures unless otherwise specified. The following properties are obtained:

| Denier | 6.19 |
|---|---|

-continued

| | |
|---|---|
| Straight Tenacity (g/d) | 1.5 |
| Straight Elongation (%) | 31.0 |
| Loop Tenacity (g/d) | 1.2 |
| Loop Elongation (%) | 17.0 |
| Reversible Crimp Shrinkage (%) (F above) | 19.0 |

EXAMPLE 2

The procedure of Example 1 is repeated except that the second water-stretching is at a stretch ratio 2.1 giving a total stretch ratio of 10.0. Total shrinkage (relaxation) is 37%. Fiber properties are as follows:

| | |
|---|---|
| Denier | 6.2 |
| Straight Tenacity (g/d) | 1.8 |
| Straight Elongation (%) | 37.0 |
| Loop Tenacity (g/d) | 1.5 |
| Loop Elongation (%) | 19.0 |
| Reversible Crimp Shrinkage (%) (F above) | 15.0 |

Comparative Example A

The solution of the hydrophobic polymer of Example 1 is spun alone eliminating the static mixing unit but otherwise using the spinnerette and conditions specified in Example 1. Total relaxation shrinkage is 35.5%.

| Fiber properties are as follows: | |
|---|---|
| Denier | 6.0 |
| Reversible Crimp Shrinkage (%) | 4.3 |

Comparative Example B

The solution of the hydrophilic polymer of Example 1 is spun alone eliminating the static mixing unit but otherwise using the spinnerette and conditions employed in Example 1. Total relaxation shrinkage is 38%.

| Fiber properties were as follows: | |
|---|---|
| Denier | 6.3 |
| Reversible Crimp Shrinkage (%) | 3.9 |

The results of Comparative Examples A and B indicate that the monocomponent filaments of either the hydrophobic or the hydrophilic polymers of Example 1 alone do not provide significant specific reversible crimp shrinkage.

Comparative Example C

The procedure of Example 1 is followed in every material detail except that the number of elements in the static mixing unit is increased to 5, giving an average number of interfaces per filament of 2.57, and the total stretch ratio is increased to 16.5 by conducting the air stretch at a stretch ratio of 2.4, the first hot water stretch at a ratio of 4.3, and the second hot water stretch at a ratio of 1.6. The total shrinkage after relaxing is 37%.

| Fiber properties are as follows: | |
|---|---|
| Denier | 6.3 |
| Reversible Crimp Shrinkage (%) | 8.4 |

This result indicates the the stretch ratio was too high and had an adverse effect on the percent of reversible crimp obtained.

Comparative Example D

The procedure of Example 1 is again followed in every material detail with the following exceptions;

1. The circular spinnerette contains 180 orifices, each of 75 microns diameter;
2. The static mixing unit contains 2 elements, giving a calculated average number of interfaces faces per filament of 0.20;
3. The restretch ratio is 1.0; and
4. The steam relaxation is conducted at 22 psig.

A microscope slide is prepared of a cross-section of the tow and it is dyed so as to distinguish between the hydrophobic and hydrophilic polymers employed. Under the microscope, the various components of the tow are counted. Results are given in Table I.

EXAMPLE 3

The procedure of Comparative Example D is repeated in very material detail with the following exception: The number of elements in the static mixing unit is 3 and the calculated average number of interfaces per filament is 0.47.

Results are given in TAble I.

EXAMPLE 4

The procedure of Comparative Example D is again repeated in every material detail with the following exception: the static mixing unit contains 4 elements and the calculated average number of interfaces per filament is 1.02.

Results are also given in Table I.

EXAMPLE 5

The procedure of Comparative Example D is repeated in every material detail with the following exception: the number of elements in the static mixing unit is 5 and calculated average number of interfaces per filament is 2.10.

Results are given in Table I.

TABLE I

RELATIONSHIP OF REVERSIBLE CRIMP SHRINKAGE TO CROSS-SECTION FILAMENT COUNT

| Measurements | Comp. Example D | Examples 3 | 4 | 5 |
|---|---|---|---|---|
| A. Wet Longitudinal Shrinkage (%) | -5.8 | -4.6 | -6.2 | -4.3 |
| B. Chemical Crimp Shrinkage (%) | 4.3 | 5.2 | 5.8 | 4.2 |
| C. Total Longitudinal Shrinkage (%) | 2.4 | 5.5 | 14.2 | 10.9 |
| D. Dry Longitudinal Shrinkage (%) | 8.2 | 10.1 | 20.4 | 15.2 |
| E. Total Crimp Shrinkage (%) | 14.0 | 23.8 | 26.9 | 17.9 |
| F. Reversible Crimp Shrinkage (%) | 9.7 | 18.6 | 21.1 | 13.7 |
| G. Total Tow Shrink- | 16.4 | 29.3 | 41.1 | 28.7 |

TABLE I-continued

| RELATIONSHIP OF REVERSIBLE CRIMP SHRINKAGE TO CROSS-SECTION FILAMENT COUNT | | | | |
|---|---|---|---|---|
| | Comp. Example | Examples | | |
| Measurements | D | 3 | 4 | 5 |
| age (%) | | | | |
| Filaments Cross-Section Counts | | | | |
| Monocomponent (No Interface) | 50.0 | 41.0 | 22.9 | 9.9 |
| Bicomponent (1 Interface) | 37.9 | 40.8 | 28.7 | 18.4 |
| Poly(Bicomponent) (2 Interfaces) | 9.2 | 14.8 | 17.1 | 20.4 |
| Poly(Bicomponent) (>2 Interfaces) | 2.7 | 3.4 | 31.2 | 51.3 |

EXAMPLES 6–14

The procedure of Example 4 is repeated in every material detail except that the steam pressure used to conduct relaxation of the tow is varied. The variations in steam pressure as well as shrinkage measurements are given in Table II, indicating that a broad range of steam relaxation pressures (beyond a minimum around 12 psig) can be used to obtain the desired reversible crimp shrinkage.

TABLE II

| EXAMPLE NO. | 6 | 7 | 8 | 9 | 10 | 11 | 12 | 13 | 14 |
|---|---|---|---|---|---|---|---|---|---|
| STEAM RELAXATION PRESSURE (PSIG) | 15 | 18 | 20 | 22 | 32 | 22 | 25 | 28 | 30 |
| TOTAL RELAXATION % | 28.3 | 30.1 | 31.1 | 32.7 | 40.0 | 33.3 | 34.0 | 36.8 | 38.4 |
| A. WET LONGITUDINAL SHRINKAGE (%) | −5.6 | −5.7 | −6.2 | −6.2 | −4.4 | −7.3 | −7.1 | −6.7 | −5.4 |
| B. CHEMICAL CRIMP SHRINKAGE (%) | 6.8 | 6.8 | 5.0 | 5.8 | 4.0 | 5.2 | 6.4 | 5.3 | 4.5 |
| C. TOTAL LONGITUDINAL SHRINKAGE (%) | 15.3 | 14.6 | 13.0 | 14.2 | 15.0 | 3.8 | 2.6 | 5.1 | 5.4 |
| D. DRY LONGITUDINAL SHRINKAGE (%) | 20.9 | 20.3 | 19.2 | 20.4 | 19.4 | 11.1 | 9.7 | 11.8 | 10.8 |
| E. TOTAL CRIMP SHRINKAGE (%) | 19.8 | 23.0 | 22.8 | 26.8 | 20.6 | 30.5 | 27.5 | 33.4 | 26.8 |
| F. REVERSIBLE CRIMP SHRINKAGE (%) | 13.1 | 16.2 | 17.8 | 21.0 | 16.6 | 25.3 | 21.1 | 28.1 | 21.6 |
| G. TOTAL TOW SHRINKAGE (%) | 35.2 | 37.6 | 35.8 | 41.1 | 35.5 | 34.3 | 30.1 | 38.4 | 31.7 |

EXAMPLE 15

The procedure of Comparative Example D is repeated in every material detail with the following exceptions: the circular spinnerette employed contains 12,884 orifices each of 100 microns diameter; the number of elements employed in the static mixing unit is 7 giving a calculated average number of interfaces per filament of 1.02; the total stretch ratio is 10.0; drying is at 230° F.; the restretch ratio is 1.1; and relaxation is in steam at 35 psig.

Shrinkage properties are given in Table III.

EXAMPLE 16

The procedure of Example 15 is followed in every material detail except that the separate polymers dopes are metered into the static mixing unit such that the ratio of hydrophobic to hydrophilic polymer in the resulting filament tow is 58/42, respectively.

Shrinkage properties are given in Table III.

TABLE III

| VARIATION OF COMPONENT RATIO | | |
|---|---|---|
| POLYMER FEED | Ex. 15 | Ex. 16 |
| Hydrophobic/Hydrophilic | 50/50 | 58/42 |
| A. Wet Longitudinal Shrinkage (%) | 4.2 | 4.0 |
| B. Chemical Crimp Shrinkage (%) | 5.7 | 6.3 |
| C. Total Longitudinal Shrinkage (%) | 7.5 | 9.3 |
| D. Dry Longitudinal Shrinkage (%) | 3.3 | 5.3 |
| E. Total Crimp Shrinkage (%) | 29.7 | 31.7 |
| F. Reversible Crimp Shrinkage (%) | 16.5 | 16.1 |
| G. Total Tow Shrinkage (%) | 29.7 | 31.7 |

EXAMPLE 17

The procedure of Example 15 is followed in every material detail with the following exceptions: the circular spinnerette contains 21,000 orifices, each of 75 microns and the number of elements in the static mixing unit is 7 so that the calculated average number of interfaces per filament is 0.805; the total stretch ratio is 8.0 and drying is at 200° F.

| Properties are as follows: | Example 17 | Commercial Side-by-side Bicomponent Fiber* |
|---|---|---|
| A. Wet Longitudinal Shrinkage (%) | 5.7 | 1.5 |
| B. Chemical Crimp Shrinkage (%) | 6.8 | 12.3 |
| C. Total Longitudinal Shrinkage (%) | 6.8 | 5.3 |
| D. Dry Longitudinal Shrinkage (%) | 1.1 | 3.8 |
| E. Total Crimp Shrinkage (%) | 29.0 | 32.8 |
| F. Reversible Crimp Shrinkage (%) | 22.2 | 20.5 |
| G. Total Tow Shrinkage (%) | 35.8 | 38.1 |

*Spun with special spinnerettes which keep polymer dopes separate until they emerge from spinerette.

EXAMPLE 18

The polymers employed are as follows:

| Hydrophobic | Ingredient | Hydrophilic |
|---|---|---|
| 89.4% | Acrylonitrile | 88.0% |
| 10.6% | Methyl methacrylate | 6.8% |
| 0.0% | 2-Acrylamido-2-methylpropane sulfonic acid | 5.2% |
| 0.13% | Sulfur | 0.73% |
| 1.0 | Ratio of $—SO_3Na$ | 6.6 |
| | Polymer solutions compositions: | |
| 13.3% | Polymer | 12.1% |
| 39.4% | NaSCN | 40.9% |
| 47.2% | Water | 47.0% |
| 38 poises | Viscosity (40° C.) | 11 poises |

The static mixing unit contains 3 elements and the circular spinnerette contains 180 orifices, each of 75 micron diameter. The calculated average number of interfaces per filament is 0.47. The spinning dope issuing from the static mixing unit is spun at 50/50 polymer ratio at 70° C. into a coagulating bath of 14.7% NaSCN at 0° C. The emerging tow is stretched in air at a stretch ratio of 2.5 and washed with water. It is then stretched in a first hot water bath at 81° C. at a stretch ratio of 1.5 and in a second hot water bath at 82° C. at a stretch ratio of 1.68, for a total stretch ratio of 8, the filaments contained 50% of each polymer.

The tow is dried in an oven in a relaxed state at 127° C. dry bulb and 65° C. wet bulb. The tow is further relaxed by steaming at 30 psig in a pressure chamber to provide a total shrinkage of 38% based on the length of the wet tow leaving the final stretch bath.

The resulting tow has a reversible crimp shrinkage of 18.0%.

EXAMPLE 19

The hydrophobic polymer employed is as in Example 18. The hydrophilic polymer has the following composition:

| | |
|---|---|
| Acrylonitrile | 92.1% |
| Methyl methacrylate | 5.35% |
| 2-Acrylamido-2- | 3.35% |
| Methylpropane sulfonic acid | 4.55% |
| % Sulfur | 0.77% |
| % $-SO_3Na$ | 2.48% |
| Ratio of $SO_3Na$ (hydrophobic/ hydrophilic polymer) | 1:5.9 |

The spinning conditions are as in Example 18 with the following exceptions: the number of elements in the static mixing unit is 4 and the calculated average number of interfaces per filament in the tow is 1.02; stretching temperatures are 90° C. in first hot water bath and 88° C. in the second. Steaming is at 22 psig to provide a total shrinkage of 32.8%.

The resulting tow has a reversible crimp shrinkage of 16.8%.

EXAMPLE 20

| Hydrophobic | Ingredient | Hydrophilic |
|---|---|---|
| 92.5% | Acrylonitrile | 89.1% |
| 7.5% | Methyl methacrylate | 6.7% |
| 0.0% | 2-Acrylamido-2-methylsulfonic acid | 4.2% |
| 0.125% | Sulfur | 0.715% |
| 0.40% | $-SO_3Na$ | 2.30% |
| 1 | Ratio $-SO_3Na$ | 5.75 |
| | Polymer solutions compositions: | |
| 12.5% | Polymer | 13.5% |
| 39.0% | NaSCN | 39.4% |
| 48.5% | Water | 47.1% |
| 26.5 poise | Viscosity (40oC) | 35 poise |

The static mixing unit contains 4 elements and the circular spinnerette contains 180 orifices, each of 75 microns. The calculated average number of interfaces per filament is 1.02. Processing is as in Example 18 except that steaming is run at 3 levels on separate portions of the tow. Results are as follows:

| Steam Pressure | Total Relaxation Shrinkage % | Reversible Crimp Shrinkage % |
|---|---|---|
| 22 psig | 29.8 | 26.2 |
| 30 psig | 32.3 | 32.5 |
| 35 psig | 34.2 | 28.9 |

We claim:

1. A process for producing an acrylonitrile polymer fiber tow having a reversible crimp shrinkage of at least about 12% which comprises preparing separate concentrated aqueous thiocyanate salt solvent spinning solutions of two acrylonitrile polymers containing 1) at least about 85 weight percent acrylonitrile and 2) sulfonic acid groups, one of said polymers containing a sufficient number of sulfonic acid groups to be hydrophilic, the ratio of said sulfonic acid groups of one polymer to those of the other polymer being in the range of 2.1:1 to 9:1, layering the solutions by simultaneously charging them each through opposite sides of a mixing unit at a flow rate that provides a mixture of polymers in the resulting tow in a ratio of about 70:30 to 30:70 of the hydrophilic polymer to the other, said mixing unit being equipped with a number of of flow-reversing cutting elements, charging the resultant layered polymer solutions into a spinnerette having a rectangular or circular shape and a number of orifices such that I is between about 0.4 to about 2.8 as determined by the equation:

$$I = \frac{2^n - 1}{K \times (\text{no. of spinnerette orifices})^{\frac{1}{2}}}$$

wherein the superscript n is the number of cutting elements and K is a constant equal to 1.0 for rectangular spinnerettes and 1.1 for circular spinnerettes to form fibers, charging said fibers into a diluted aqueous thiocyanate salt solution coagulation bath to provide wet-gel filaments, stretching the wet-gel filaments at a total stretch ratio of between about 6 and about 15, inclusive, washing and drying the resultant stretched fibers to provide a tow and treating the tow under heat and humidity conditions sufficient to provide an acrylic fiber bundle having a reversible crimp shrinkage therein of at least about 12%, said filaments comprising A) monocomponent filaments of said hydrophilic polymer, B) monocomponent filaments of said other polymer, C)bicomponent filaments of both of said polymers and D) bicomponent filaments of both of said filaments having an average of about 0.4 to about 2.8 interfaces between polymer components.

2. The process of claim 1 wherein the reversible crimp shrinkage is at least about 16%.

3. The process of claim 1 wherein the reversible crimp shrinkage is at least about 20%.

4. The process of claim 1 wherein the reversible crimp shrinkage is at least about 25%.

5. The process of claim 1 wherein the ratio of one polymer to the other is 50:50.

* * * * *